US010681466B2

(12) United States Patent
Danovi

(10) Patent No.: US 10,681,466 B2
(45) Date of Patent: Jun. 9, 2020

(54) LOUDSPEAKER WITH DUAL PLATE STRUCTURE

(71) Applicant: Alpine Electronics, Inc., Tokyo (JP)

(72) Inventor: Benny Danovi, Ypsilanti, MI (US)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 15/947,148

(22) Filed: Apr. 6, 2018

(65) Prior Publication Data

US 2019/0313193 A1 Oct. 10, 2019

(51) Int. Cl.

| | |
|---|---|
| ***H04R 9/00*** | (2006.01) |
| ***H04R 9/02*** | (2006.01) |
| ***H04R 9/06*** | (2006.01) |
| *H04R 7/12* | (2006.01) |

(52) U.S. Cl.

CPC ..... *H04R 9/025* (2013.01); *H04R 9/06* (2013.01); *H04R 7/12* (2013.01); *H04R 2209/022* (2013.01)

(58) Field of Classification Search

CPC ..... H04R 9/00; H04R 9/025; H04R 9/027
USPC ..... 381/396, 412, 414, 419
See application file for complete search history.

(56) References Cited

U.S. PATENT DOCUMENTS

| | | | | |
|---|---|---|---|---|
| 4,365,114 | A | 12/1982 | Soma | |
| 4,661,973 | A | 4/1987 | Takahashi | |
| 4,933,975 | A * | 6/1990 | Button | H04R 9/022 381/397 |
| 6,430,300 | B1 | 8/2002 | Cox et al. | |
| 6,678,387 | B2 * | 1/2004 | Kemmerer | H04R 9/022 381/419 |
| 6,829,366 | B2 | 12/2004 | Tanabe | |
| 7,283,642 | B2 | 10/2007 | Milot et al. | |
| D559,835 | S | 1/2008 | Marshall | |
| 7,426,283 | B2 * | 9/2008 | Kaiya | H04R 9/022 381/419 |
| 7,433,487 | B2 | 10/2008 | Shimamura | |

(Continued)

FOREIGN PATENT DOCUMENTS

| | | |
|---|---|---|
| JP | 1990113488 | 9/1990 |
| JP | 1994269076 | 9/1994 |

(Continued)

OTHER PUBLICATIONS

Wet Sounds, "Owner's Manual," Wet Sounds Inc., Mar. 20, 2012, 2 pages.

(Continued)

*Primary Examiner* — Suhan Ni
(74) *Attorney, Agent, or Firm* — Knobbe, Martens, Olson & Bear, LLP

(57) ABSTRACT

A magnetic circuit assembly may be used in a loudspeaker. The magnetic circuit may include a magnet that has a central axis. The magnet can have a first surface and a second surface that is opposite the first surface. The magnet may produce magnetic field axially through the first and second surfaces of the magnet. The second surface of the magnet may have an inner radial region and an outer radial region. The magnetic circuit assembly can further include a yoke that is disposed adjacent the first surface of the magnet. The yoke can be shaped to form a first gap radially between the yoke and the magnet. The magnetic circuit assembly may further include first and second plates disposed adjacent the second surface of the magnet.

20 Claims, 6 Drawing Sheets

(56) References Cited

U.S. PATENT DOCUMENTS

| | | | |
|---|---|---|---|
| D652,408 | S | 1/2012 | Chen |
| 8,150,095 | B2 | 4/2012 | Kemmerer |
| 8,983,104 | B2 | 3/2015 | Shimamura |
| 9,479,873 | B2 | 10/2016 | Yamagami et al. |
| 2005/0031154 | A1 | 2/2005 | Stiles |
| 2015/0023545 | A1 | 1/2015 | Kumakura |

FOREIGN PATENT DOCUMENTS

| | | |
|---|---|---|
| JP | 1999341574 | 12/1999 |
| JP | 3657814 | 6/2005 |
| JP | 3946047 | 7/2007 |
| JP | 2008131269 | 6/2008 |

OTHER PUBLICATIONS

Extended European Search Report, Application No. 19166804.5, dated Aug. 2, 2019.

* cited by examiner

LOUDSPEAKER WITH DUAL PLATE STRUCTURE

BACKGROUND

Field

This disclosure relates generally to loudspeakers and to magnetic circuits for loudspeakers.

Description of Related Art

Loudspeakers provide listeners quality sound audible from a distance and through various media. Various configurations of loudspeakers have been developed over the years. Current loudspeakers have some functionality with regard to developing a magnetic circuit and converting electrical energy into sound waves. Various magnetic circuit assemblies have been developed to channel magnetic fields in various electrical devices, including loudspeakers. However, many features are lacking and many problems exist in the art for which this application provides solutions.

SUMMARY

Example embodiments described herein have innovative features, no single one of which is indispensable or solely responsible for their desirable attributes. Without limiting the scope of the claims, some of the advantageous features will now be summarized.

In some embodiments, a magnetic circuit for a loudspeaker may include a magnet that has at least one central axis. The magnet can have a first surface and a second surface opposite each other. The magnet may produce a magnetic field axially through the first and second surfaces of the magnet. The second surface of the magnet can have an inner radial region and an outer radial region. The loudspeaker may also include a yoke that is disposed adjacent the first surface of the magnet and that is shaped to form a first gap radially between the yoke and the magnet. The loudspeaker can include a first plate that is disposed adjacent the inner radial region of the second surface of the magnet such that the first plate forms a second gap radially between the first plate and the yoke. The loudspeaker may further include a second plate that is disposed adjacent the outer radial region of the second surface of the magnet such that the second plate forms a third gap radially between the second plate and the yoke. The second gap may be disposed between the first gap and the third gap.

In certain embodiments, a cross section of the yoke forms a U-shape. In some designs, at least the third gap is configured to receive a voice coil therein. The first and second plates can form a fourth gap axially therebetween.

In some embodiments, a loudspeaker may include a magnetic circuit. The loudspeaker may include a front plate assembly that includes a first plate and a second plate. The loudspeaker may further include a voice coil that is disposed within a voice coil region that includes the third gap described above. A diaphragm may be included that is connected to the voice coil. The loudspeaker can include a frame that is configured to support the diaphragm such that the frame is connected to at least the magnet and the front plate assembly.

In some embodiments, a first leg of the yoke is longer than a second leg of the yoke. A cross section of the second plate may form an S-shape. In some designs, the voice coil region includes the second gap described above such that at least a portion of the voice coil is disposed between the first plate and the yoke.

BRIEF DESCRIPTION OF THE DRAWINGS

The following drawings and the associated descriptions are provided to illustrate embodiments of the present disclosure and do not limit the scope of the claims.

Figure 1:
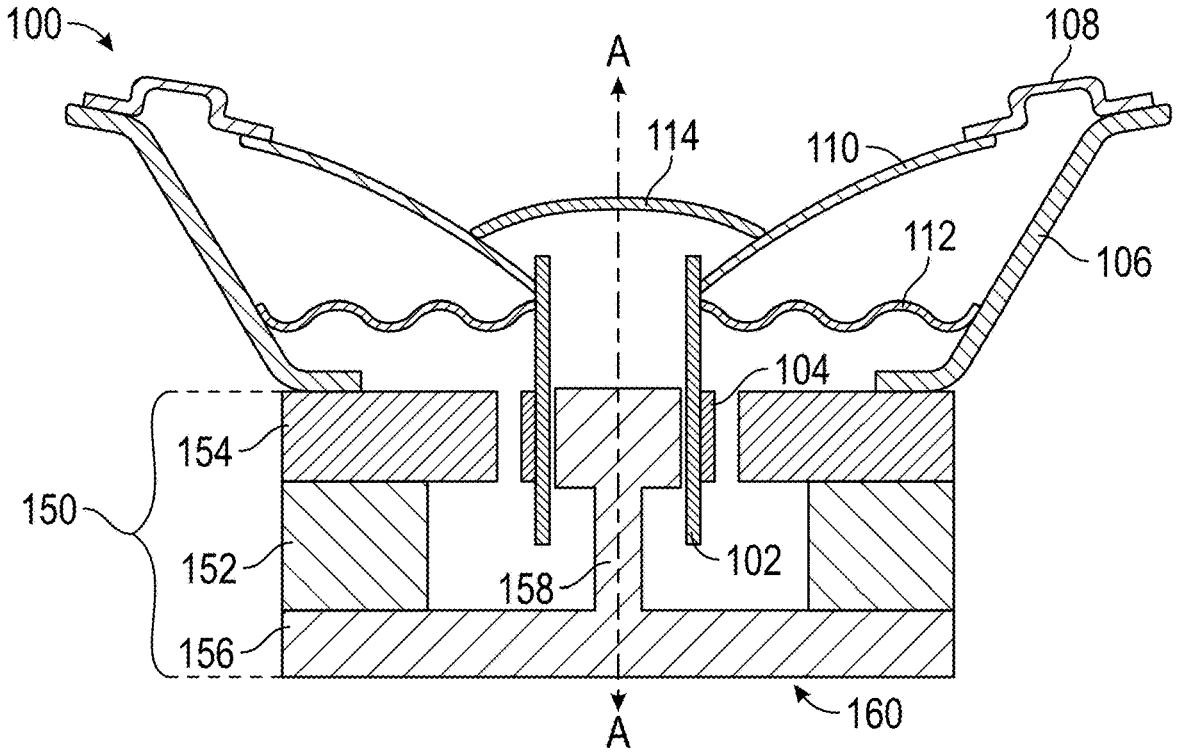
FIG. 1 schematically shows a cross-section of an example loudspeaker 100 design.

These and other features will now be described with reference to the drawings summarized above. The drawings and the associated descriptions are provided to illustrate embodiments and not to limit the scope of any claim. Throughout the drawings, reference numbers may be reused to indicate correspondence between referenced elements. In addition, where applicable, the first one or two digits of a reference numeral for an element can frequently indicate the figure number in which the element first appears.

DETAILED DESCRIPTION

Although certain embodiments and examples are disclosed below, inventive subject matter extends beyond the specifically disclosed embodiments to other alternative embodiments and/or uses and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Described herein are methodologies and related systems for loudspeakers and magnetic circuit assemblies. It will be understood that although the description herein is in the context of loudspeakers and magnetic circuits, one or more features of the present disclosure can also be implemented in other electrical devices, such as generators, electromagnets, electric motors, and the like. Some embodiments of the methodologies and related systems disclosed herein can be used with various loudspeaker designs.

Unless explicitly indicated otherwise, terms as used herein will be understood to imply their customary and ordinary meaning.

FIG. 1 schematically shows a cross-section of a loudspeaker 100 with a ring magnet design. A loudspeaker 100 may include one or more components described herein. However, because not every element of the loudspeaker 100 is required in every embodiment, no single element should be viewed as indispensable to the loudspeaker 100. The loudspeaker 100 shown in FIG. 1 represents a circular magnet (or annular magnet) design. However, core magnet designs may also be implemented using designs substantially similar to those described herein with modest adjustments. An example of such an embodiment is provided by FIG. 3. Minor differences between a design in FIG. 1 and one in FIG. 3 would be clear to one of ordinary skill in the art and are omitted in favor of clarity and brevity.

The loudspeaker 100 is shown with a central axis A about which the loudspeaker 100 has approximate radial symmetry. Accordingly, FIG. 1 represents elements that may appear to be duplicated but may be representative of a common element disposed about an axis. In some designs, however, multiple elements may be used for a single feature.

The loudspeaker 100 includes a frame 106. In some embodiments, the frame 106 may be called a basket or a housing. At or near a first end of the frame 106, the frame may be attached to a front plate assembly 154 of a magnetic circuit assembly 150. The front plate assembly 154 may comprise a receiving portion (not shown) for receiving the attachment of the frame 106. The frame 106 may be adhered (e.g., glued), bonded (e.g., soldered, welded), or otherwise affixed in another way to the front plate assembly 154. For example, in some embodiments a pressure fit configuration may be used. In some designs, one or more screws may be used to attach the frame 106 to the front plate assembly 154. In some embodiments, the frame 106 may be attached to a resilient connector 108 at or near a second end of the frame. In some embodiments, the frame 106 may be attached directly to a diaphragm 110.

The frame 106 may comprise a thin plate of a rigid material (e.g., steel, plastic, synthetic resin, wood). In some embodiments, the frame 106 comprises a nonmagnetic material (e.g., aluminum or aluminum alloy). The frame 106 may also attach to a damper 112. The frame 106 may exhibit radial symmetry or approximate radial symmetry about the central axis A.

The resilient connector 108 may be called a surround, an elastic edge, or an outer suspension. The resilient connector 108 may be bonded to the frame 106. The resilient connector 108 may be attached to the frame 106 using an attachment device. For example, in some designs a gasket can be used. In some embodiments, the resilient connector 108 comprises a thin sheet of rigid or resilient material. Because it comprises a sufficiently thin material, even if the material is rigid, the resilient connector 108 can support minor perturbations between the frame 106 and the diaphragm 110.

The loudspeaker 100 may also include a damper 112. The damper 112 may also be referred to as a spider or inner suspension in some embodiments, though other terms may be used. A first end of the damper 112 may be connected to the frame 106 closer to the first end than the second end of the frame 106. A second of the damper 112 may be attached to a bobbin 102. The damper 112 may support the bobbin 102 to allow the bobbin 102 to vibrate while preventing or reducing contact of either the bobbin 102 or coil 104 with parts of the magnetic circuit assembly 150 (e.g., the front plate assembly 154, pole piece 158). The bobbin 102 may be attached to the damper 112 in a number of different ways (e.g., bonded, adhered). In some embodiments, the damper 112 may comprise a resin-containing cloth. The damper 112 may comprise a resin plate that forms a ring. As shown from the side, as in FIG. 1, the damper 112 may be radially corrugated. The radially corrugation may be formed concentric with the central axis A.

A loudspeaker 100 may generally include a diaphragm 110. As the diaphragm vibrates, sound may be produced and/or amplified. The diaphragm 110 may also be referred to as a cone (e.g., sound cone). Generally, the diaphragm 110 comprises a hole in the center of the diaphragm 110, thus forming a ring. The diaphragm 110 may comprise a resilient material (e.g., resin, cloth, plastic, paper, fibers, etc.). In many embodiments, the diaphragm 110 is radially symmetrical about the central axis A. In such embodiments, sound can be concentrated in a direction along the central axis A. The diaphragm 110 (e.g., at an inner periphery of the diaphragm 110) may be attached to or near a first end of the bobbin 102. The resilient connector 108 may be attached (e.g., bonded, adhered) to an outer periphery of the diaphragm 110.

Near the inner periphery of the diaphragm 110, a cap 114 may be attached. The cap 114 may be referred to as a dome, a dust cap, or a dust cover in various embodiments. The cap 114 can be centered on the central axis A. In some embodiments, the cap 114 may be coaxial with the pole piece 158 and/or yoke assembly 160. The cap 114 may "close" the bobbin 102. As shown, in some designs the cap 114 has a dome shape.

In some embodiments, the loudspeaker 100 includes a bobbin 102. In some embodiments, the bobbin 102 may be referred to as a former or coil former. The bobbin 102 may form a ring surrounding the central axis A. In some designs, the bobbin 102 extends axially at least to an axial position of the front plate assembly 154. Accordingly, the bobbin 102 may form a cylindrical shape. However, the bobbin 102 may extend further, as shown in FIG. 1. Other alternatives are possible. As shown, the diaphragm 110 and/or the damper 112 may be attached (e.g., bonded, adhered) to or near a first axial end of the bobbin 102.

The bobbin 102 may be configured to support a coil 104. The coil 104 may be referred to as a voice coil in some embodiments. The coil 104 may be attached or otherwise secured to the bobbin 102 using a number of means (e.g., adhered, bonded). The coil 104 can be configured to receive an electric current therethrough. The electric current creates a magnetic field that interacts with a magnetic field produced by the magnet 152. For example, the interaction may cause the coil 104 to translate axially back and forth. This interaction can cause the coil 104, and thereby the bobbin 102, to vibrate axially along the central axis A and/or radially. The vibration can be transferred to, for example, the diaphragm 110 to produce a target sound based on an electrical input.

The coil 104 may comprise a series of windings of a conductive material (e.g., metal) wrapped around the bobbin 102. The windings may have a radial thickness extending radially from the bobbin 102. The radial thickness may be smaller than a gap (not labeled in FIG. 1) between the front plate assembly 154 and the pole piece 158. For example, the coil 104 may be disposed between an outer radius of the pole piece 158 and an inner radius of the front plate assembly 154. In some designs, the coil 104 comprises the same number of windings (e.g., turns) of the conductive material axially along the portion of the bobbin 102 to which it is secured. Having such a homogeneous distribution of windings can create a more uniform magnetic field along the height (e.g., measured axially) of the coil 104. The height of the coil 104 may be less than a corresponding height of the front plate assembly 154 and/or portion of the pole piece 158.

The loudspeaker 100 generally includes a magnetic circuit assembly 150. Generally, the magnetic circuit assembly 150 may include a front plate assembly 154, a magnet 152, and a yoke assembly 160. The yoke assembly 160 may comprise a back plate 156 and/or a pole piece 158. As in the other elements described with reference to FIG. 1, the elements of the magnetic circuit assembly 150 are depicted only schematically. For example, the front plate assembly 154 may comprise one or more elements. Similarly, the magnet 152, back plate 156, and/or pole piece 158 may comprise one or more elements.

In some embodiments, the front plate assembly 154 is axially adjacent the magnet 152 and can have a central axis in common with the central axis A of the magnet 152. However, other arrangements are possible. The front plate assembly 154 may be secured to the magnet 152. For example, the front plate assembly 154 may be attached using an adhesive (e.g., glue) or a bonding technique. The region where the front plate assembly 154 is attached to the magnet 152 can be called an interface layer. It may be advantageous to reduce a distance (e.g., gaps) between the front plate assembly 154 and the magnet 152, such as a thickness of the interface layer, which can comprise glue or other connection material. Various embodiments of the front plate assembly 154 are described in more detail below.

A magnet 152 may be used to create a magnetic flux across a gap between the front plate assembly 154 and the pole piece 158. The magnet 152 may be a permanent magnet (e.g., comprising neodymium or a ferrous material, such as ferrite) or a temporary magnet (e.g., electromagnet). For example, a ring magnet design may include ferrite and/or a core magnet design may include neodymium. Other variations are possible.

The magnet 152 may be disposed between the front plate assembly 154 and the back plate 156. The magnet 152 may be oriented to produce a magnetic field axially through first and second surfaces of the magnet, the first surface being opposite the second surface. For example, the poles of the magnet may be oriented parallel to axis A. In some designs, the second surface has an inner radial region and an outer radial region, described in more detail below.

The yoke assembly 160 (e.g., the back plate 156) may be secured (e.g., adhered) to the magnet 152 on a surface of the magnet 152 opposite to the surface to which the front plate assembly 154 is secured. The yoke assembly 160 may be attached using an adhesive (e.g., glue), a bonding technique, or any other suitable technique. It may be advantageous to reduce a distance (e.g., gaps and/or an interface layer) between the front plate assembly 154 and the magnet 152, such as any caused by gluing or other attachment means. Various embodiments of the yoke assembly 160 (including the back plate 156 and/or pole piece 158) are described in more detail below.

Figure 2:
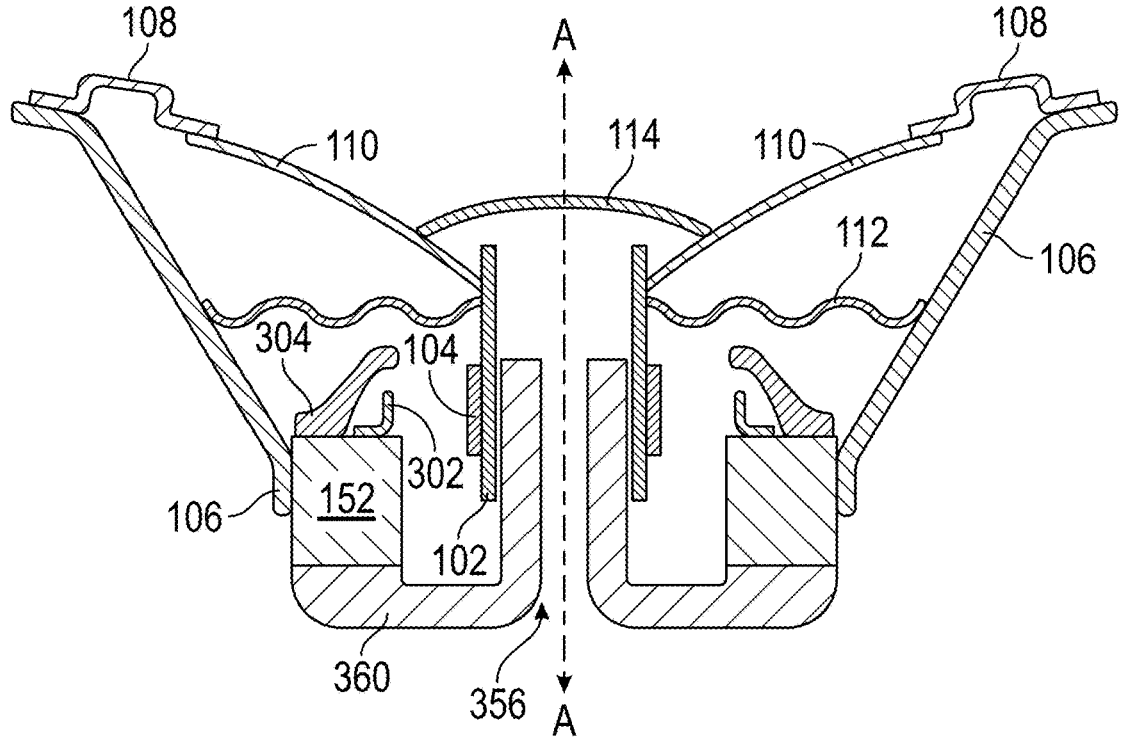
FIG. 2 shows a schematic of a cross section of an example embodiment of a ring magnet design of a loudspeaker.

FIG. 2 shows a schematic of a cross section of an example embodiment of a ring magnet design of a loudspeaker 100. Commonly numbered elements may include functionality of the numbers described elsewhere herein. The loudspeaker 100 may include a magnetic circuit assembly that includes a magnet 152; a front plate assembly that comprises a first plate 302 and a second plate 304; and a yoke 360. The first plate 302 and/or second plate 304 may be manufactured (e.g., forged) separately and attached to the magnet 152. The frame 106 may be attached to the magnet 152 or other part of the front plate assembly. In some embodiments, the frame 106 can be attached radially adjacent the back plate 156 and/or on an underside of the back plate 156. This may help dissipate heat from the loudspeaker 100. As shown in FIG. 2, the coil 104 may be disposed between the bobbin 102 and the front plate assembly. A height (measured axially) of the coil 104 may be less than a height of the front plate assembly. This can provide a greater proportion of the coil 104 that is within a target region of magnetic flux. For example, such a region be one having a relatively consistent magnetic flux across the region (see also FIGS. 8A-8B below).

The first plate 302 and the second plate 304 may each be disposed adjacent the magnet 152. A distance between the first plate 302 and/or second plate 304 and the magnet 152 may be less than 0.5 mm. For example, this distance may be about 0.1 mm. The distance may comprise a glue gap between the respective components. In some embodiments, a cross section of the first plate 302 forms an L-shape. The first plate 302 may comprise a material with high magnetic permeability, such as iron. In some embodiments, a cross section of the second plate 304 forms an S-shape. As shown in FIG. 2, at least a portion of the first plate 302 may be disposed between the magnet 152 and the second plate 304. In some designs, the first plate 302 is disposed between the magnet 152 and the second plate 304 along an axis parallel the axis A. The second plate 304 may comprise a metal, such as steel (e.g., a low carbon steel), iron, and/or composite materials (e.g., metamaterials that may have a higher magnetic permeability than metals or metal alloys). Additional details related to the front plate assembly shown in FIG. 2 are discussed with regard to FIG. 6 below.

The loudspeaker 100 may further include a shorting ring (not shown). The shorting ring may be disposed between the bobbin 102 and the yoke 360. Additional details about the shorting ring are discussed below. The yoke 360 can be solid along the central axis A. Alternatively, as shown in FIG. 2, the yoke 360 may include a vent 356 therein. The vent 356 may help provide cooling for the loudspeaker 100 and/or magnetic circuit assembly.

Figure 3:
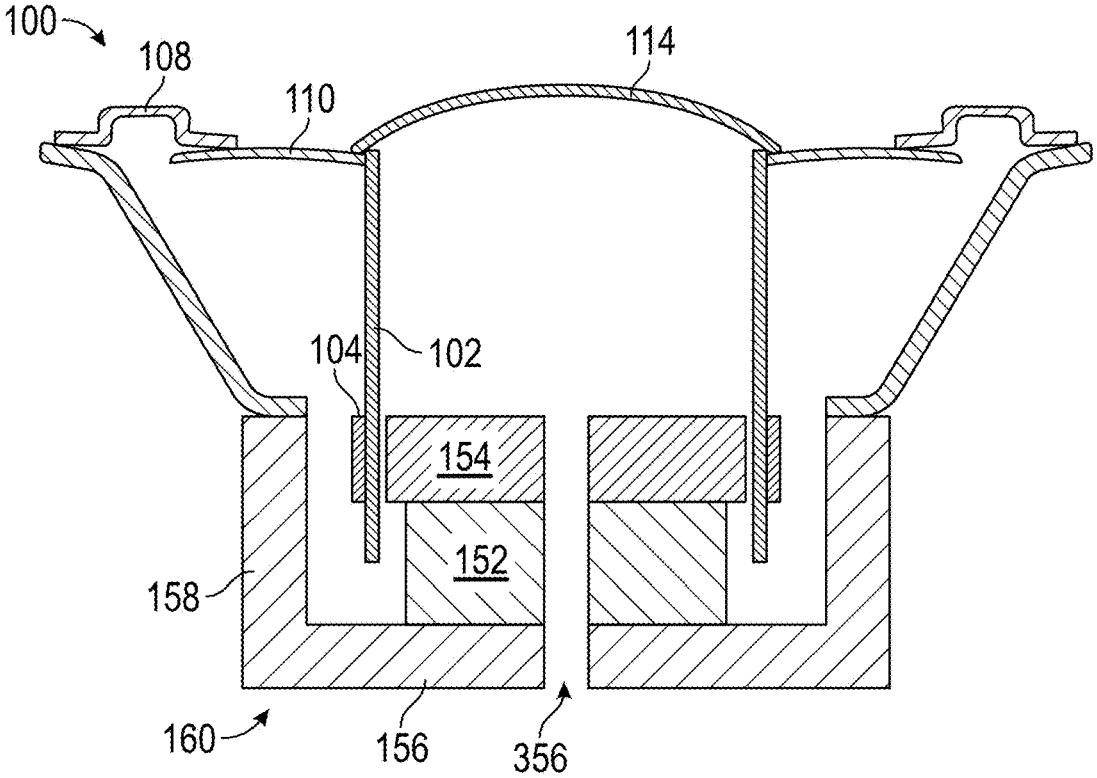
FIG. 3 schematically shows a cross-section of a loudspeaker with a core magnet design.

As noted above, a core magnet design may be used instead of a ring magnet design. Many of the components used in the core magnet design are similar or the same as those described with regard to the ring magnet designs. FIG. 3 schematically shows a cross-section of a loudspeaker 100 with a core magnet design. As shown, the coil 104 may be disposed between the pole piece 158 and the bobbin 102 and/or the front plate assembly 154. The bobbin 102 may be disposed between the coil 104 and the front plate assembly 154. As shown, the pole piece 158 may be disposed radially outward from the magnet 152 and/or front plate assembly 154. The loudspeaker 100 may include a vent 356. In some embodiments, a loudspeaker 100 with a core magnet design may include a shorting ring (not shown). One or more shorting rings may be disposed near the pole piece 158 and/or the front plate assembly 154, such as between the pole piece 158 and the coil 104. Other variations are also possible, as described herein.

Figure 4:
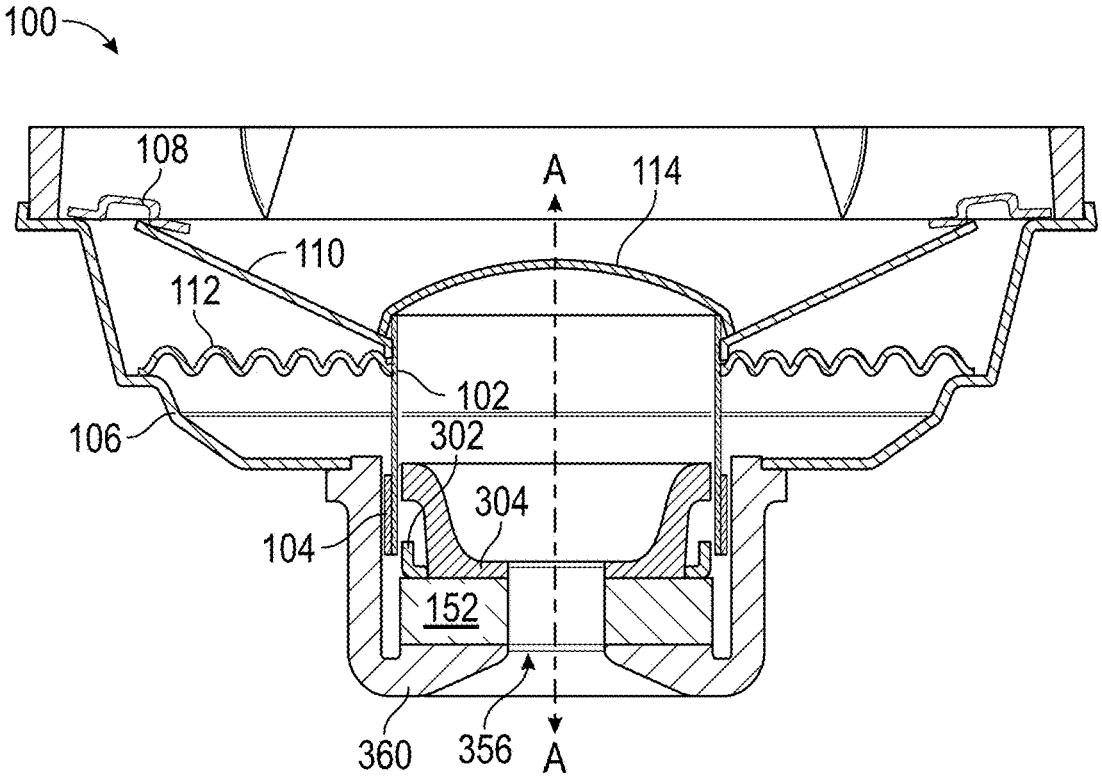
FIG. 4 shows a schematic of a cross section of an example embodiment of a core magnet design of a loudspeaker.

FIG. 4 shows a schematic of a cross section of an example embodiment of a core magnet design of a loudspeaker 100. The radial orientation of the magnetic circuit assembly is essentially opposite of the orientation of the assembly in FIG. 2, relative to the central axis A. As shown, in some embodiments the coil 104 is disposed between the yoke 360 and the bobbin 102. A height (measured axially) of the coil 104 may be smaller than a height of the second plate 304. Additional details of the magnetic circuit assembly and other elements of the loudspeaker 100 are provided below (for example, with regard to FIG. 6).

Figure 5:
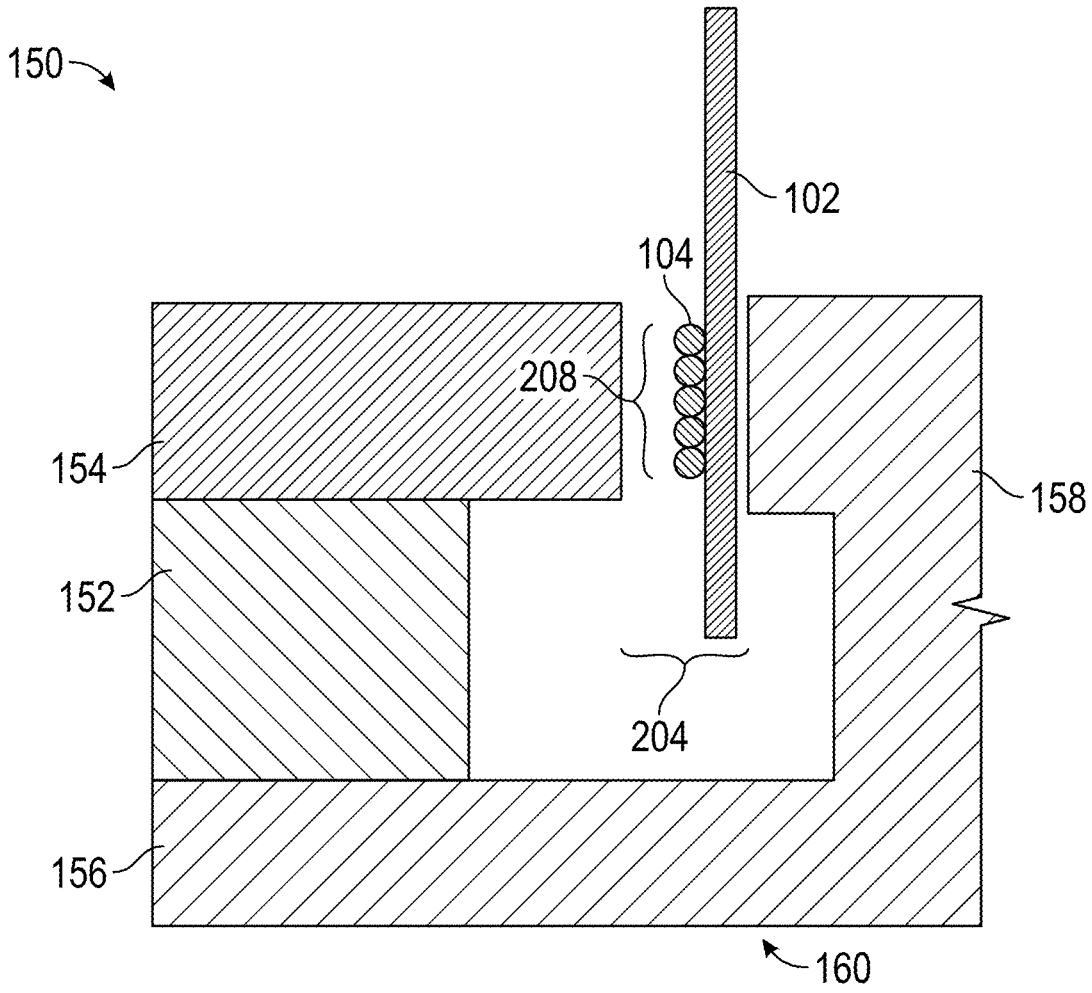
FIG. 5 shows a schematic of a cross-section of a magnetic circuit assembly that can be used in a loudspeaker.

FIG. 5 shows a schematic of a cross-section of a portion of a magnetic circuit assembly 150 that may, for example, be used in a loudspeaker. In some embodiments, a pole piece 158 may be used to complete a magnetic circuit within the magnetic circuit assembly 150. In some designs, the pole piece 158 includes one or more vents (e.g., hollow portion running axially through the pole piece 158), not shown in FIG. 1. Such vents may be beneficial in cooling the magnetic circuit assembly 150 and/or loudspeaker 100. The one or more vents could be disposed axially below the coil 104 (e.g., between the magnet 152 and the pole piece 158). Accordingly, one or more vents may be disposed radially from the axis A. The loudspeaker 100 can include a plurality of vents, such as 3, 4, 6, or 8. Where a plurality of vents is included, they may be positioned in radial symmetry. The one or more vents can be used to improve cooling, reduce the mechanical resistance, and/or reduce air noise. A vent disposed about the axis A may be more effective at reducing mechanical resistance while peripheral vents may be more effective at cooling the magnetic circuit (e.g., especially the coil 104). Such peripheral vents can promote cooling air over the coil.

The pole piece 158 may be shaped to accommodate different needs of various embodiments. In some embodiments, the pole piece 158 may be tapered at one end (e.g., front, back). This may allow for reduced manufacturing requirements, to allow for proper sizing and weight requirements for a loudspeaker, or to optimize an amount of magnetic flux through the pole piece 158, for example. As shown in FIG. 5, some embodiments include a T-shape pole piece 158 that may be useful in optimizing a target width (e.g., radial width) of a gap 204. However, in other embodiments, the pole piece 158 does not include a T-shape. In some designs, the pole piece 158 may include a surface opposite the magnet 152 that is generally smooth and/or flat. The surface may run parallel to the axis A, for example. In some embodiments, the surface represents a radial boundary of the pole piece 158. The pole piece 158 may consist of a single pole element (as shown in FIGS. 1-2), though in some embodiments the pole piece 158 comprises two or more elements.

The yoke assembly 160 provides a portion of the magnetic circuit of the magnetic circuit assembly 150. In some designs, the yoke assembly 160 includes two separate elements, such as a distinct back plate 156 and pole piece 158. However, the yoke assembly 160 may consist of a single piece where the back plate 156 and pole piece 158 form a continuous piece (as shown, for example, in FIGS. 1-2). The yoke assembly 160 may include a surface that is perpendicular to the axis A.

The magnetic circuit assembly 150 may be configured to generate a magnetic circuit through the front plate assembly 154, the yoke assembly 160, and across the gap 204. The magnetic circuit assembly 150 may be configured to pass between about 80 and 99 percent of the magnetic flux within the magnetic circuit across the gap 204. This may be particularly true for core magnet configurations. In some embodiments (e.g., a ring magnet design), the flux across the gap 204 may be between 50 and 80 percent of a total flux. In some embodiments, the flux may be about 70 percent of a total flux. Within the gap 204 may be one or more elements of the magnetic circuit assembly 150. For example, the bobbin 102 and/or coil 104 may be disposed within the gap 204. As the magnetic flux interacts with the coil 104, the coil 104 vibrates and may produce a sound, for example, from the loudspeaker 100.

As shown, in some embodiments (e.g., in ring magnet designs), the windings of the coil 104 are disposed on a side of the bobbin 102 opposite the pole piece 158. However, in other embodiments (e.g., core magnet designs), the windings of the coil 104 may be on a side of the bobbin 102 opposite the magnet 152. A height 208 of the coil 104 may be defined along the axis A (e.g., as shown in FIG. 5). In some embodiments, the height 208 of the coil 104 may be approximately equal to a height of the front plate assembly 154 and/or a T-shape portion of the yoke assembly 160 (if available). In some designs, the height 208 of the coil 104 is smaller or greater than the height of the front plate assembly 154. The height 208 may be between about 0.1 mm and 150 mm. For larger speakers, larger heights 208 are possible. A width (e.g., radially) of the coil 104 may be between about 55 percent and 90 percent of the width of the gap 204. In some embodiments, the width of the coil 104 is about 71 percent or about 75 percent of the width of the gap 204. It may be advantageous to reduce the width of the gap 204. For example, reducing the width of the gap 204 may improve a performance of the loudspeaker 100, for example, by improving integrity of the sound relative to an electrical input. The gap 204 may be between about 1 mm and 12 mm wide. In some embodiments, the gap 204 has a width of about 3.5 mm. In some embodiments, the width is about 2 mm.

Magnetic circuit assemblies, such as those found in loudspeakers, may take various forms. For example, embodiments of magnetic circuit assemblies may include one or more features of those described generally above. It may be advantageous under certain circumstances to increase the amount of magnetic flux across a gap (e.g., the gap 204). This may be achieved in a number of ways. One way may include reducing or eliminating gaps (e.g., a glue gap or other interface layer) between separate components of the magnetic circuit, including, for example, gaps between magnet 152 components, front plate 154 components, back plate 156 components, pole piece 158 components, and/or between any of the foregoing components. For example, it may be advantageous to provide separate first and second plates in the front plate assembly 154, each of which is directly secured to the magnet 152 (e.g., by glue). In some embodiments, the separate first and second front plates are forged and adhered to the magnet without machining, thus saving substantial manufacturing cost while eliminating gaps between front plate components and reducing magnetic losses.

Figure 6:
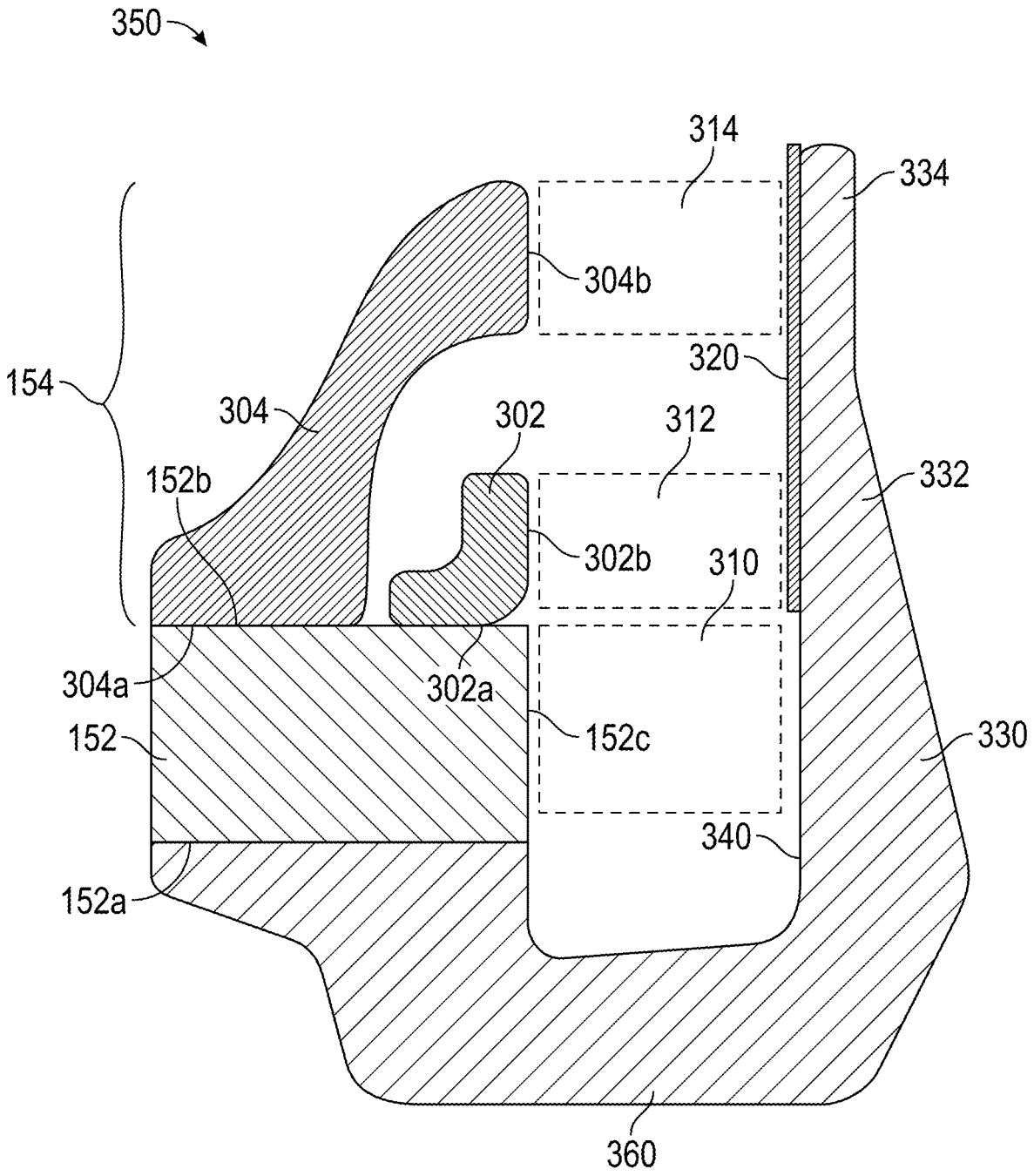
FIG. 6 shows a schematic of a cross-section of an example magnetic circuit assembly.

FIG. 6 shows a schematic of a cross-section of an example magnetic circuit assembly 350. The magnetic circuit assembly 350 may include a magnet 152; a front plate assembly 154 that comprises a first plate 302 and a second plate 304; and a yoke 360. The magnetic circuit assembly 350 may include other elements not shown and/or described below. The yoke 360 may be secured to the magnet 152 along a first surface 152*a* of the magnet 152. One or more components of the front plate assembly 154 may be secured to the magnet 152 along a second surface 152*b*. The first plate 302 and/or second plate 304 may be manufactured (e.g., forged) separately and attached to the magnet 152.

The first plate 302 may be disposed adjacent a first region (e.g., an inner radial region for a ring magnet design, an outer radial region for a core magnet design) of the second surface 152*b* of the magnet 152. A distance between the first plate 302 and the magnet 152 may be less than 0.5 mm. In some embodiments, the distance is about 0.1 mm. The first plate 302 may be secured to the magnet 152 (e.g., adjacent the first region) along a back surface 302*a* of the first plate 302. The first plate 302 may be secured to the magnet 152 using attachment means known in the art (e.g., adhesive, bonding, etc.). The back surface 302*a* of the first plate 302 may have a surface area smaller than a back surface 304*a* of the second plate 304. In some embodiments, the back surface 302*a* of the first plate 302 may be disposed orthogonal (e.g., cylindrically orthogonal) to a side surface 302*b* (e.g., an interior radial surface for a ring magnet design, an exterior radial surface for a core magnet design) of the first plate 302 (as shown in FIG. 6) and/or with the central axis A. In some designs, the side surface 302*b* of the first plate 302 is radially coincident (e.g., equidistant from the central axis A) with a third surface 152*c* of the magnet 152. In some embodiments, a cross section of the first plate 302 forms an L-shape. The first plate 302 may comprise a material with high magnetic permeability, such as steel (e.g., low carbon steel) and/or iron. Other materials with higher magnetic permeabilities are possible, such as composite materials. A height (e.g., defined axially) of the side surface 302*b* may be determined, at least in part, by the material used in the first plate 302. For example, it may be advantageous to avoid magnetic saturation of the material in the first plate 302. However, a certain minimum saturation level may be preferred. For example, in some embodiments, one or more components of the magnetic circuit (e.g., the coil 104, the front plate assembly 154, etc.) can have a saturation level of between about 85 percent and 99 percent of a saturation point of the material of the one or more components. As an example, certain types of steel (e.g., low carbon steel) may have a magnetic saturation point of about 2 T. In this example, a saturation level greater than about 90 percent (e.g., 1.8 T) and/or between about 92.5 percent (e.g., 1.7 T) and 97.5 percent (e.g., 1.95 T) may be preferred. Saturation levels in these ranges may help to reduce the influence of a current going through the coil and/or a movement of the coil 104 while in the fixed magnetic field, thus reducing flux modulation. This may also reduce resulting distortions. Further, this may also reduce the influence of the material (e.g., steel) on the inductance of the coil, further reducing distortion.

The second plate 304 of the front plate assembly 154 may be disposed adjacent a second region (e.g., outer radial region) of the second surface 152*b* of the magnet 152. A distance between the second plate 304 and the magnet 152 may be less than 0.5 mm. The first and second regions of the second surface 152*b* of the magnet 152 may not overlap.

In some embodiments, a space radially separates the first plate 302 from the second plate 304 (e.g., they are not touching). The second plate 304 may be secured to the magnet 152 (e.g., adjacent the outer radial region) along a back surface 304*a* of the second plate 304. The second plate 304 may be secured to the magnet 152 using attachment means known in the art (e.g., adhesive, bonding, etc.). The back surface 304*a* of the second plate 304 may be perpendicular to a side surface 304*b* (e.g., an inner surface) of the second plate 304 (as shown in FIG. 6) and/or with the axis A. The side surface 304*b* of the second plate 304 may be parallel and/or coplanar with the side surface 302*b* of the first plate 302. In some designs, the side surface 304*b* (e.g., an inner surface) of the second plate 304 is coplanar with the third surface 152*c* of the magnet 152. In some embodiments, a cross section of the second plate 304 forms an S-shape.

As shown in FIG. 6, at least a portion of the first plate 302 may be disposed between the magnet 152 and the second plate 304. In some designs, the first plate 302 is disposed between the magnet 152 and the second plate 304 along an axis parallel the axis A. The second plate 304 may comprise a metal, such as copper or iron. A height (e.g., defined axially) of the side surface 304*b* may be determined, at least in part, by the material used in the second plate 304. For example, it may be advantageous to avoid magnetic saturation of the material in the second plate 304. However, as described herein, certain levels of magnetic saturation may be preferred.

The yoke 360 may have common features of the yoke assembly 160 described for FIGS. 1-2 above. The yoke 360 may form a U-shape. For example, a first leg of the yoke 360 that form a first part of the "U-shape" may be secured to a first surface 152*a* of the magnet 152. A second leg of the yoke 360 that forms a second part of the "U-shape" may extend a greater axial distance than the first leg. As shown in FIG. 6, a first portion 330 of the second leg of the yoke 360 may be disposed opposite the third surface 152*c* (e.g., interior surface) of the magnet 152, forming a first gap 310. A second portion 332 of the second leg of the yoke 360 may be disposed opposite the interior surface of the first plate 302, forming a second gap 312. A third portion 334 of the second leg of the yoke 360 may be opposite the interior surface of the second plate 304, forming a third gap 314. The second leg of the yoke 360 may be tapered axially, as shown in FIG. 6. For example, the third portion 334 of the yoke 360 may be narrower than the first portion 330 of the yoke 360. An extended surface 340 of the yoke 360 may be planar and/or parallel with the axis A.

A coil 104 (not shown) may be included in the magnetic circuit assembly 350. The coil 104 may be wrapped around a bobbin 102. Other features of the coil 104 and/or bobbin 102 of the magnetic circuit assembly 350 may be as described above for FIGS. 1-2. The coil 104 may have a height 208 that extends within the second gap 312 and/or third gap 314. In some designs, the coil 104 extends from an end of the side surface 304*b* of the second plate 304 to an end of the side surface 302*b* of the first plate 302. However, the coil 104 may be shorter (e.g., have a smaller height 208) than this. In some designs, the coil 104 does not extend into the first gap 310.

Some embodiments of the magnetic circuit assembly 350 may include a shorting ring 320. The shorting ring 320 may be referred to as a Faraday loop or a shorted turn. The shorting ring 320 may comprise a metal (e.g., copper, aluminum) or other conductive material. It may be advantageous to include one or more shorting rings (e.g., the shorting ring 320) in order to improve function of the magnetic circuit assembly 350 by, for example, reducing a rise in impedance as frequency increases. The shorting ring may also reduce the effect of the current flowing through the voice coil moving across a gap (e.g., the gap 204) in the permanent magnetic field. Additionally or alternatively, the shorting ring 320 may reduce effective inductance of the coil 104 (not shown) for one or more ranges of frequencies (e.g., higher frequencies). The effective frequency range may be influenced by how much the shorting ring reduces the inductance. For example, without being limited by theory, the more the inductance that is reduced, the lower the frequency range in which the shorting ring becomes effective. In some designs, a shorting ring (e.g., the shorting ring 320) is adjacent the yoke 360. However, one or more shorting rings can be disposed in numerous configurations. For example, a shorting ring 320 may be disposed on a side of the second plate 304 opposite the first plate 302, on a side of the first plate 302 opposite the second plate 304 (e.g., between the first plate 302 and the magnet 152), between the first plate 302 and the second plate 304, and/or adjacent or near a portion of the yoke 360. For example, a shorting ring 320 can be disposed adjacent or near the yoke 360 opposite the second plate 304, opposite the first plate 302, opposite the magnet 152, and/or at a trough of the yoke 360. In certain configurations (e.g., core magnet designs), a shorting ring is disposed radially inward of the coil 104.

Figure 7:
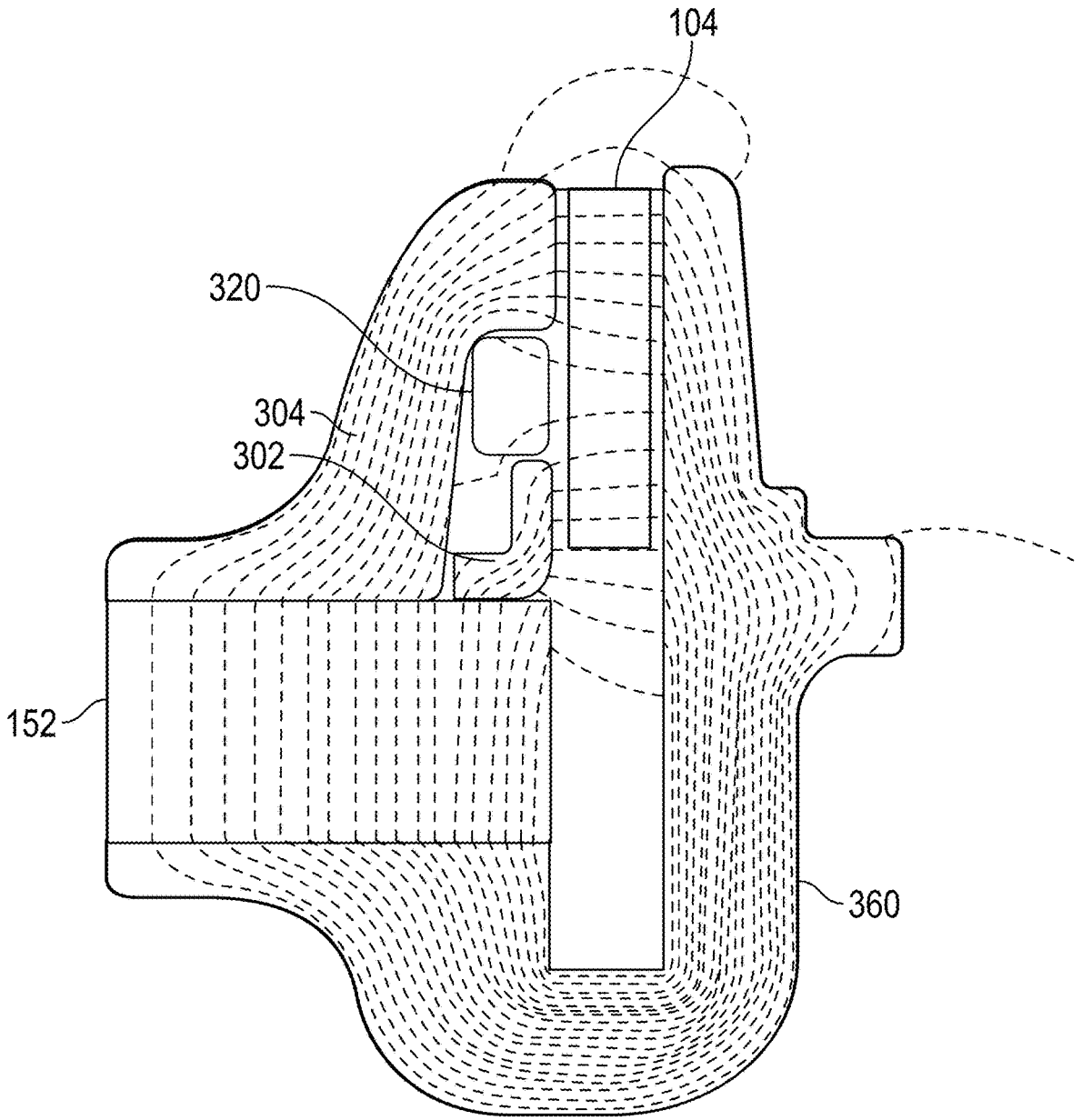
FIG. 7 shows the magnetic circuit assembly of FIG. 6 along with modeled magnetic field lines.

FIG. 7 shows the magnetic circuit assembly 350 of FIG. 6 along with modeled magnetic field lines. As shown, the magnet 152 can be oriented to produce field lines exiting the magnet 152 parallel to the central axis A. The contours of the first plate 302, the second plate 304, and the yoke 360 can produce compact field lines. Such compact field lines can prevent substantial leakage of the magnetic field out of the magnetic circuit assembly. Designs using a plurality of plates in the front plate assembly, such as shown in FIG. 7, can promote more uniform magnetic field strength across a region in which the coil 104 is disposed than other designs. FIG. 7 shows a shorting ring 320 disposed between the first plate 302 and the second plate 304. The shorting ring 320 may be adjacent one or both of the first plate 302 and/or second plate 304. For example, the shorting ring 320 may be adhered to one or both of them. Providing separate plates 302, 304 can better allow the placement of a shorting ring 320 between the plates, thus providing additional benefit of the designs described herein.

Figure 8A:
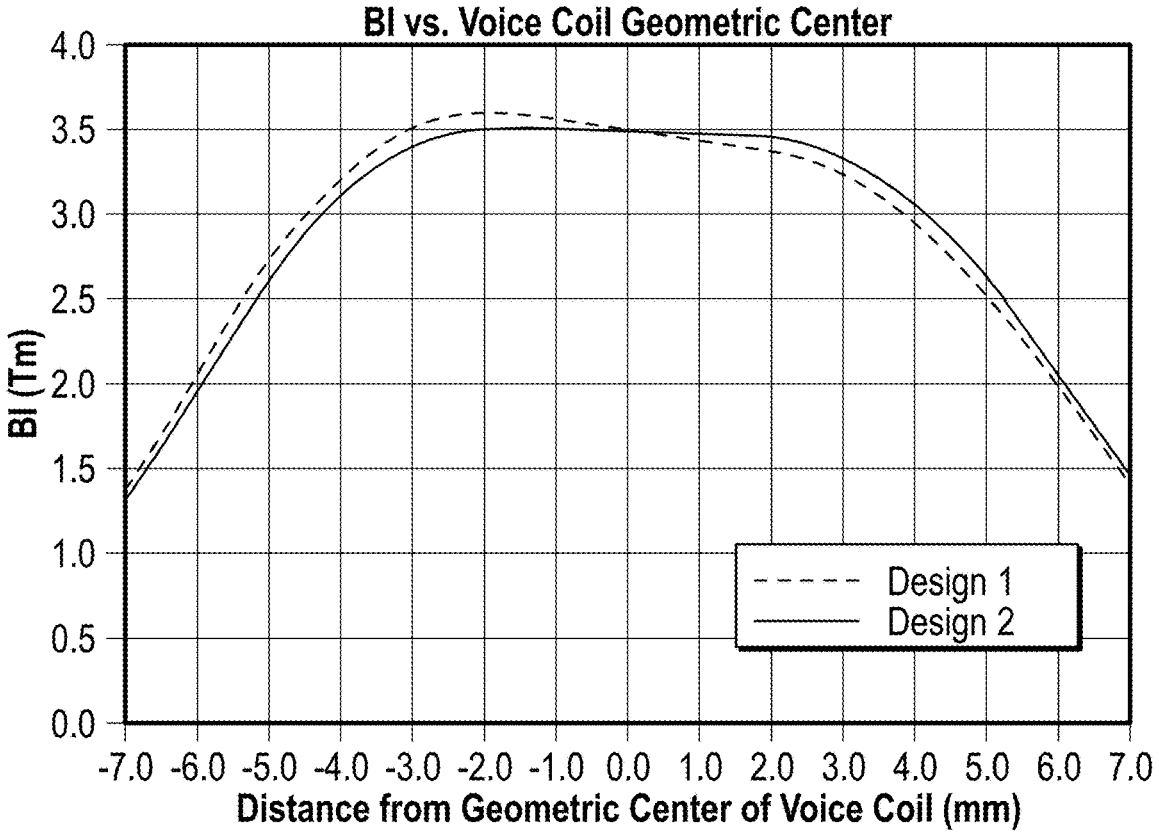
FIG. 8A shows values for the product B1 over a distance from a geometric center of a voice coil for two designs.
Figure 8B:
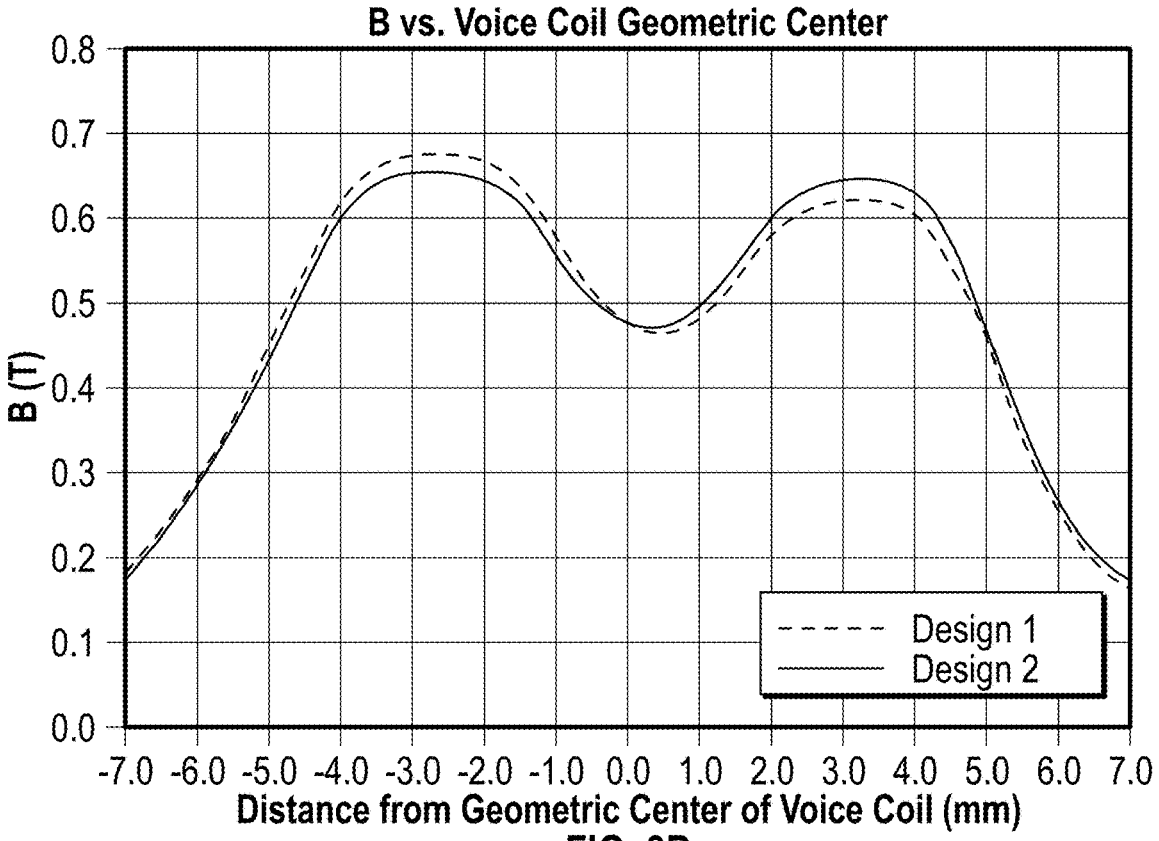
FIG. 8B shows values for the field strength B over a distance from a geometric center of a voice coil for two designs.

FIGS. 8A-8B illustrate various features of a magnetic circuit assembly shown, for example in FIGS. 6-7, ("Design 2") relative to other designs ("Design 1"). FIG. 8A shows values for the product (B1, in Tm) of magnetic field strength (B, in T) and a distance (1, in m) over a distance from a geometric center of a voice coil (in mm). The voice coil may be, for example, the coil 104. Generally, it can be advantageous to approximate a constant (or "flat") B1 value across a greater length of the voice coil position relative to a resting position of the voice coil. As shown, the B1 value of the Design 2 is flatter than Design 1, for example, from −2.0 mm to 2.0 mm. This can result in improved sound quality compared to a loudspeaker with a larger slope within the domain of −2.0 mm to 2.0 mm and increases the linearity of the response of the coil 104 to an input signal. For example, this can reduce harmonic distortions.

FIG. 8B shows values for magnetic field strength (in T) over the distance from a geometric center of the voice coil (in mm). Generally, it can be advantageous to approximate a symmetric B value across relative to a center of the voice coil. As shown, the B value of the Design 2 is more symmetric than Design 1 across the distances shown. This can improve the predictability and consistency of the sound produced from a given input.

CONCLUSION

Reference throughout this specification to "some embodiments" or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment and may refer to one or more of the same or different embodiments. Furthermore, the particular features, structures or characteristics may be combined in any suitable manner, as would be apparent to one of ordinary skill in the art from this disclosure, in one or more embodiments.

As used in this application, the terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Similarly, it should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment. Accordingly, no feature or group of features is necessary or indispensable to each embodiment.

A number of applications, publications, and external documents may be incorporated by reference herein. Any conflict or contradiction between a statement in the body text of this specification and a statement in any of the incorporated documents is to be resolved in favor of the statement in the body text.

Although described in the illustrative context of certain preferred embodiments and examples, it will be understood by those skilled in the art that the disclosure extends beyond the specifically described embodiments to other alternative embodiments and/or uses and obvious modifications and equivalents. Thus, it is intended that the scope of the claims which follow should not be limited by the particular embodiments described above.

What is claimed is:

1. A magnetic circuit for a loudspeaker, the magnetic circuit comprising:

a magnet comprising at least one central axis, a first surface, and a second surface, wherein the magnet produces magnetic field axially through the first and second surfaces of the magnet, the first surface being opposite the second surface, and the second surface having an inner radial region and an outer radial region;

a yoke disposed adjacent the first surface of the magnet, the yoke shaped to form a first gap radially between the yoke and the magnet;

a first plate disposed in direct contact with the inner radial region of the second surface of the magnet, the first plate forming a second gap radially between the first plate and the yoke; and a second plate disposed in direct contact with the outer radial region of the second surface of the magnet, the second plate forming a third gap radially between the second plate and the yoke;

wherein the second gap is disposed between the first gap and the third gap.

2. The magnetic circuit of claim 1, wherein a cross section of the yoke forms a U-shape.

3. The magnetic circuit of claim 1, wherein at least the third gap is configured to receive a voice coil therein.

4. The magnetic circuit of claim 1, wherein the first and second plates form a fourth gap axially therebetween.

5. The magnetic circuit of claim 1, wherein an interface layer between the magnet and the second plate has a thickness that is less than or equal to 0.5 mm.

6. The magnetic circuit of claim 1, wherein an area of the inner radial region is less than an area of the outer radial region.

7. The magnetic circuit of claim 1, wherein a cross section of the first plate forms an L-shape.

8. The magnetic circuit of claim 1, wherein the magnet comprises a ring magnet.

9. A loudspeaker comprising:

the magnetic circuit of claim 1; and a front plate assembly comprising the first plate and the second plate;

a voice coil disposed within a voice coil region comprising the third gap;

a diaphragm connected to the voice coil; and a frame configured to support the diaphragm, wherein the frame is connected to at least the magnet and the front plate assembly.

10. The loudspeaker of claim 9, wherein a cross section of the yoke forms a U-shape, and a first leg of the yoke is longer than a second leg of the yoke.

11. The loudspeaker of claim 9, wherein a cross section of the second plate forms an S-shape.

12. The loudspeaker of claim 9, wherein the voice coil region comprises the second gap, and wherein at least a portion of the voice coil is disposed between the first plate and the yoke.

13. The loudspeaker of claim 9, wherein the magnet comprises a third surface different from the first and second surfaces, and wherein a side surface of the first plate is parallel with the third surface of the magnet.

14. The loudspeaker of claim 9, a surface of the yoke is radially coincident with a side surface of one or more of the first plate or second plate.

15. The loudspeaker of claim 9, wherein the magnet comprises a permanent magnet.

16. The loudspeaker of claim 9, wherein a shorting ring is disposed adjacent at least one of the first or second plates.

17. The loudspeaker of claim 16, wherein the shorting ring is disposed axially between the first plate and the second plate.

18. The loudspeaker of claim 9, wherein a leg of the yoke is tapered.

19. The loudspeaker of claim 9, wherein the voice coil is disposed between a bobbin and the yoke.

20. The loudspeaker of claim 9, wherein the first plate is disposed radially between the central axis of the magnet and the second plate.

* * * * *